US009976834B1

(12) United States Patent
Cheng et al.

(10) Patent No.: US 9,976,834 B1
(45) Date of Patent: May 22, 2018

(54) FLIP-UP GUN SIGHT

(71) Applicants: Carson Cheng, City of Industry, CA (US); Changan Tian, City of Industry, CA (US); Richard Thomas, City of Industry, CA (US)

(72) Inventors: Carson Cheng, City of Industry, CA (US); Changan Tian, City of Industry, CA (US); Richard Thomas, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days. days.

(21) Appl. No.: 15/650,962

(22) Filed: Jul. 16, 2017

(51) Int. Cl.
*F41G 1/16* (2006.01)
*F41G 1/06* (2006.01)
*F41G 1/00* (2006.01)

(52) U.S. Cl.
CPC ..... *F41G 1/16* (2013.01); *F41G 1/06* (2013.01); *F41G 1/00* (2013.01)

(58) Field of Classification Search
CPC ..... F41G 1/16; F41G 1/06
USPC ..... 42/138, 147, 148, 111, 140
See application file for complete search history.

(56) References Cited

U.S. PATENT DOCUMENTS 358,747 A * 3/1887 Holman ..... F41G 1/18 42/138
2,223,004 A * 11/1940 Holek ..... F41A 3/72 89/159
6,732,467 B1 * 5/2004 Luth ..... F41G 1/16 42/138
7,721,482 B1 * 5/2010 Swan ..... F41G 1/033 42/148
8,015,744 B1 * 9/2011 Swan ..... F41G 1/065 42/133
8,191,302 B1 * 6/2012 Swan ..... F41G 1/04 362/110
9,046,320 B2 * 6/2015 Keng ..... F41G 11/003
9,261,330 B2 * 2/2016 Troy ..... F41G 1/17
9,448,035 B2 * 9/2016 Wilson ..... F41G 11/003

* cited by examiner

*Primary Examiner* — Reginald Tillman, Jr.
(74) *Attorney, Agent, or Firm* — Raymond Y. Chan; David and Raymond Patent Firm

(57) ABSTRACT

A flip up gun sight includes a sight body which includes: a sight housing having a pivotal end; a base member having a right tab and a left tab slidably connected with the pivotal end of the sight housing; a supporting member having a first supporting end pivotally connected with the sight housing, and a second supporting end pivotally connected with the base member; and a locking and folding mechanism which includes a pair of sliding slots formed on the right and left tabs, and a first mounting pin adapted to pivotally connect with the sight housing and sight base member to guide the sight housing for operating between a raised position and a down position.

22 Claims, 10 Drawing Sheets

FLIP-UP GUN SIGHT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a gun sight, and more particularly to a flip up gun sight which can be operated between a raised position and a down position through a folding and locking mechanism.

Description of Related Arts

The traditional sight mechanism for firearms, such as rifles, shotguns and handguns, is very bulky and commonly mounted on a barrel of the firearm, so it is usually protruded outside the contour of the firearm. The configuration of the traditional sight mechanism is a static and upright structure to assist the operator to locate the target, so the configuration of the traditional sight mechanism create greater opportunities for being catching on clothing or brushes while the firearm is being carried. Therefore, it is very dangerous for the operator to carry on the firearm with a traditional sight mechanism when they are moving, so the operator needs to detach the sight mechanism from the firearm before their movements, and attach the traditional sight mechanism again for alignment, and the sight mechanism must be re-aligned before it is ready to use. However, the re-alignment for the sight mechanism can be acceptable for using in a controllable environment, such as a firing range, but it is very dangerous for hunting or battlefield uses.

In addition, different firearm accessories, such as scope devices and illumination light module, are also required to be mounted on the barrel of the firearm to assist the operator to perform the shooting. However, the traditional sight mechanism and other accessories must be mounted on the firearm to parallel to a barrel axis of the firearm. Therefore, other accessories and the sight mechanism cannot be mounted on the barrel of the firearm at the same time as long as the sight mechanism will be shadowed by an optical image generated by the other accessories. In other words, while sight mechanism is mounted on the top of the firearm, the illumination light module must be mounted on the side of the firearm, so the gripping area of the handguard will be minimized.

Accordingly, it is a burden for the operators to stow the firearm with the sight mechanism. A clearance is generated between two protruded and upright sight mechanism while a plurality of firearms are piled with each other, so the firearms with protruded and upright sight mechanism on the top position are easily to fall down cause that the top portions of the firearms are not streamline contours. Therefore, it is highly desired that the protruded and upright sight mechanism must be quickly folded in a compact configuration when needed, and when the sight mechanism are moved from the non-use position to the use position, the sight mechanism does not need to re-align.

SUMMARY OF THE PRESENT INVENTION

The invention is advantageous in that it provides a flip up gun sight which comprises a base member, a supporting member pivotally connected with the base member, and a sight housing pivotally connected with the supporting member and slidably connected with the base member, wherein the sight housing can be selectively operated between a raised position for aligning and a down position for out of alignment through a locking and folding mechanism.

Another advantage of the invention is to provide a flip up gun sight, wherein the said sight housing are slidably connected with the base member through a first mounting pin and a pair of sliding slots formed on the base member. In other words, the first mounting pin is sliding along the sliding slots while the sight housing is operated between the raised and down position.

Another advantage of the invention is to provide a flip up gun sight, wherein the sliding slots have downward curvatures which are matched with a moving path of the sight housing, which can guide the pivotal end of the sight housing being moved along the sliding slots. In other words, the first mounting pin is located in a top end of the sliding slots while the sight housing is in the raised position, and then slid in a bottom opposite end of the sliding slots in order to perform the down position for the sight housing.

Another advantage of the invention is to provide a flip up gun sight, wherein, in the raised position, the supporting member is inclinedly and pivotally connected with the sight housing and the base member while the sight housing is vertically connected with the base member, so the supporting member is adapted to support the sight housing in the upright position.

Another advantage of the invention is to provide a flip up gun sight, wherein when the sight housing is pushed to fall down, the supporting member is synchronizedly fallen down to be received into a housing cavity of the base member. Therefore, the operator is able to quickly stow the sight housing and the supporting member in the down position while the sight housing is out of alignment.

Another advantage of the invention is to provide a flip up gun sight, wherein the locking and folding mechanism further comprises a locking groove formed on the supporting member, and a locker member having a locking hook selectively engaged with the locking groove to lock the supporting member in a fall-down position. In other words, the sight housing is also locked in the down position.

Another advantage of the invention is to provide a flip up gun sight, wherein the locker member can be selectively pressed to release the locking hook from the locking groove, so as to simplify the operations of the flip up gun sight by means of one hand operation.

Another advantage of the invention is to provide a flip up gun sight, wherein the folding and locking mechanism further comprises a torsion spring having a first spring end coupled on the base member, a spring body receiving around a second mounting pin adapted for pivotally connect with the supporting member and the base member, and a second spring end arranged adjacent to the supporting member to support the supporting member in the inclined position. In other words, the second spring end of the torsion spring is shaped as a slope less than or the same as a slope of the supporting member in order to support the supporting member in the inclined position.

Another advantage of the invention is to provide a flip up gun sight, wherein the supporting member and the sight housing are synchronizedly moved between the raised position and the down position, so the flip up gun sight can be not only quickly folded in the down position, but also be able to securely stand in the raised position.

Additional advantages and features of the invention will become apparent from the description which follows, and may be realized by means of the instrumentalities and combinations particular point out in the appended claims.

According to the present invention, the foregoing and other objects and advantages are attained by a flip up gun sight, comprising:

a sight body which comprises:

a sight housing comprising a pivotal end;

a base member comprising a right tab and a left tab slidably connected with the pivotal end of the sight housing;

a supporting member having a first supporting end pivotally connected with the sight housing, and a second supporting end pivotally connected with the base member; and a locking and folding mechanism which comprises a pair of sliding slots formed on the right and left tabs, and a first mounting pin adapted to pivotally connect with the sight housing and sight base member to guide the sight housing for operating between a raised position and a down position.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
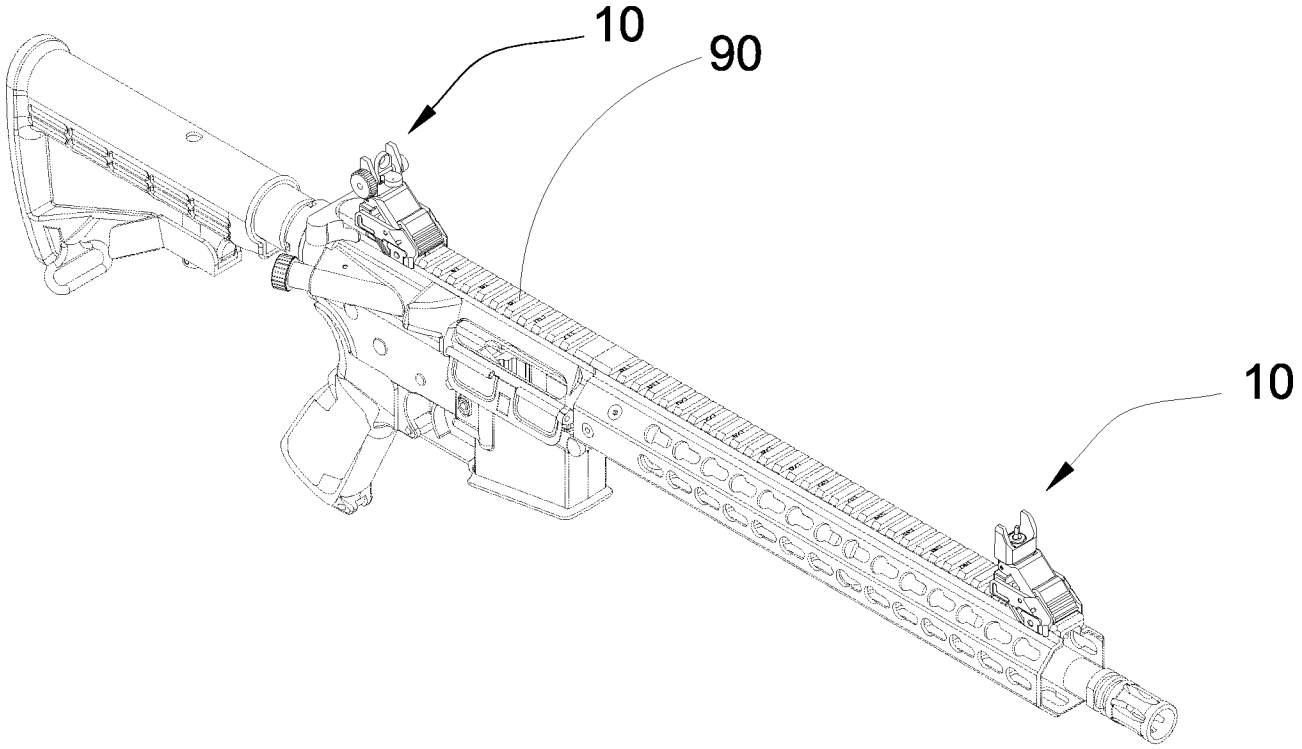
FIG. 1 is a perspective view of a flip up gun sight mounted on a firearm according to a preferred embodiment of the present invention.
Figure 2:
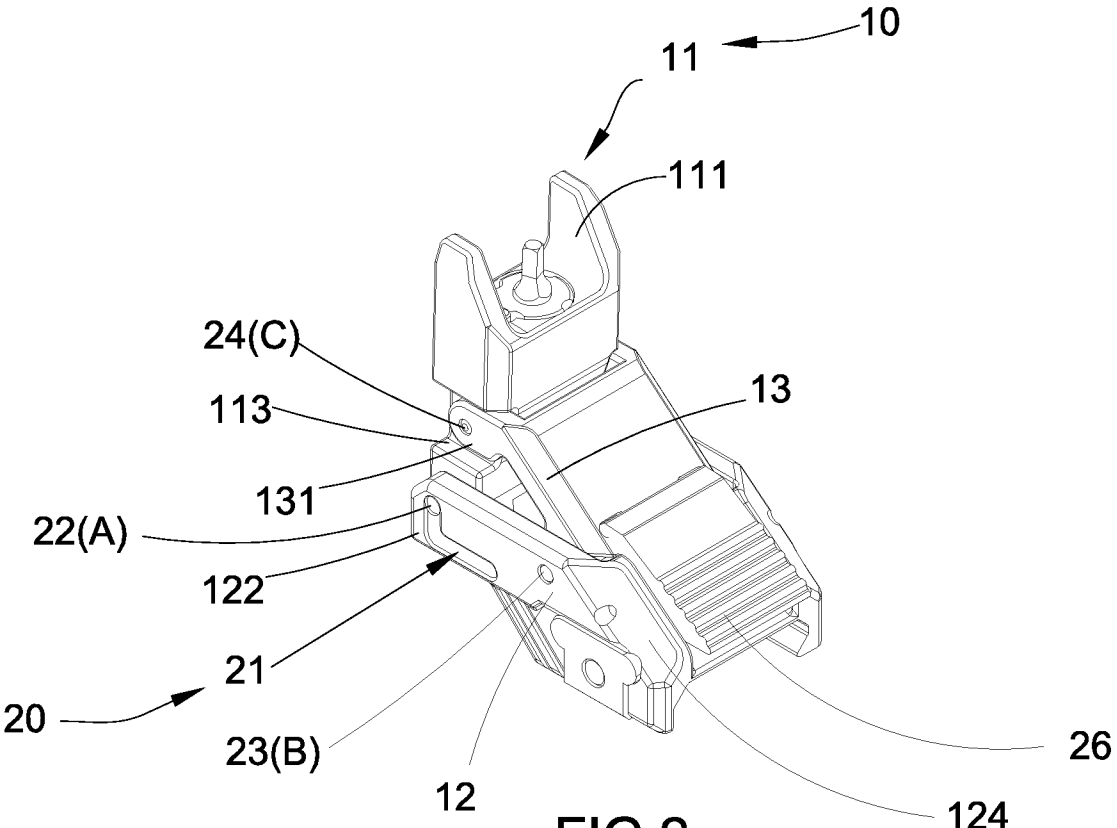
FIG. 2 is a perspective view of a flip up gun slip according to a preferred embodiment of the present invention.
Figure 3:
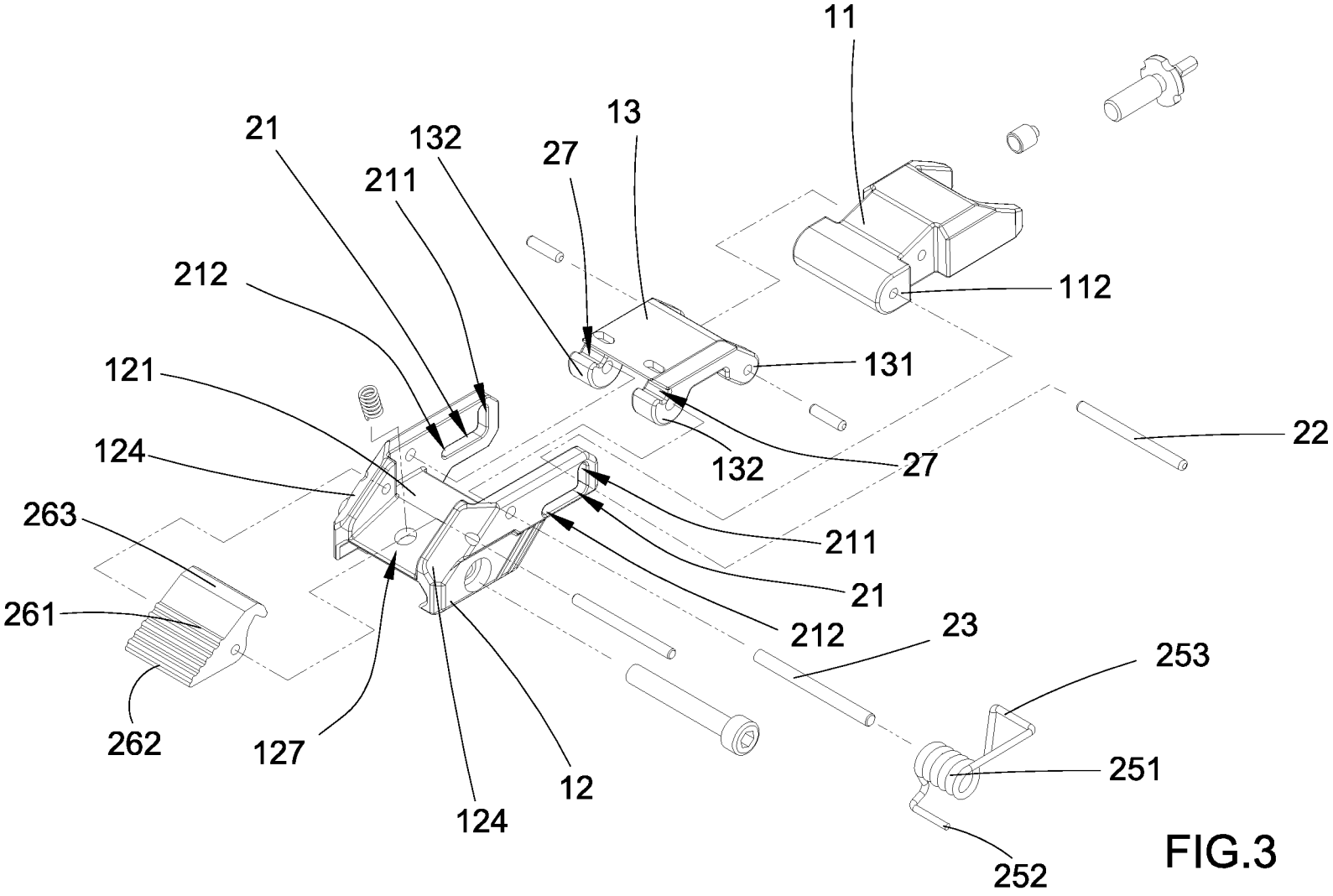
FIG. 3 is an exploded view of a flip up gun sight according to the above mentioned preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 6J of the drawings, a flip up gun sight according to a first preferred embodiment of the present invention is illustrated, wherein the flip up gun sight comprises a sight body 10 and a locking and folding mechanism 20. The flip up gun sight is adapted to mount on a barrel 90 of a firearm, such as M4/M16 type rifle, for aiming.

The sight body 10 comprises a sight housing 11 having a U-shaped alignment end 111, a pivotal opposite end 112, and a middle portion 113 defined between the U-shaped alignment end 111 and the pivot end 112, a base member 12 pivotally connected with the pivotal end 112 of the sight housing 11, and a supporting member 13 having a first supporting end 131 pivotally connected with the middle portion 113 of the sight housing 11 and a second supporting end 132 pivotally connected with the base member 12, wherein the sight housing 11 and the supporting member 13 can be synchronizedly operated between a raised position and a down position while the locking and folding mechanism is in a unlock position, and be remained at the down position while the locking and folding mechanism 20 is in a lock position.

The base member 12 comprises a mounting arrangement located on a bottom portion 121 thereof to be mounted on the barrel 90 of the firearm, a right tab 122, and a left tab 123, wherein the right tab 122 and the left tab 123 are transversely and parallelly extended approximately one half of the base transversal distance from the bottom portion 121 of the base member 12. The base member 12 further comprises a housing cavity 125 defined between the right tab 122 and the left tab 123, and the pivotal end 112 of the sight housing 11 is resided in the housing cavity 125, and is slidably connected with the right tab 122 and the left tab 123. Accordingly, the mounting arrangement can be configured to have a "Weaver" mounting structure, a "Picatinny" mounting structure, or "KeyMod" mounting structure to detachably mount on the firearm. The base member 12 further comprises two protruded ends 124 integrally and upwardly extended from the bottom portion 121 of the base member 12 to form a locker cavity 127.

Figure 4:
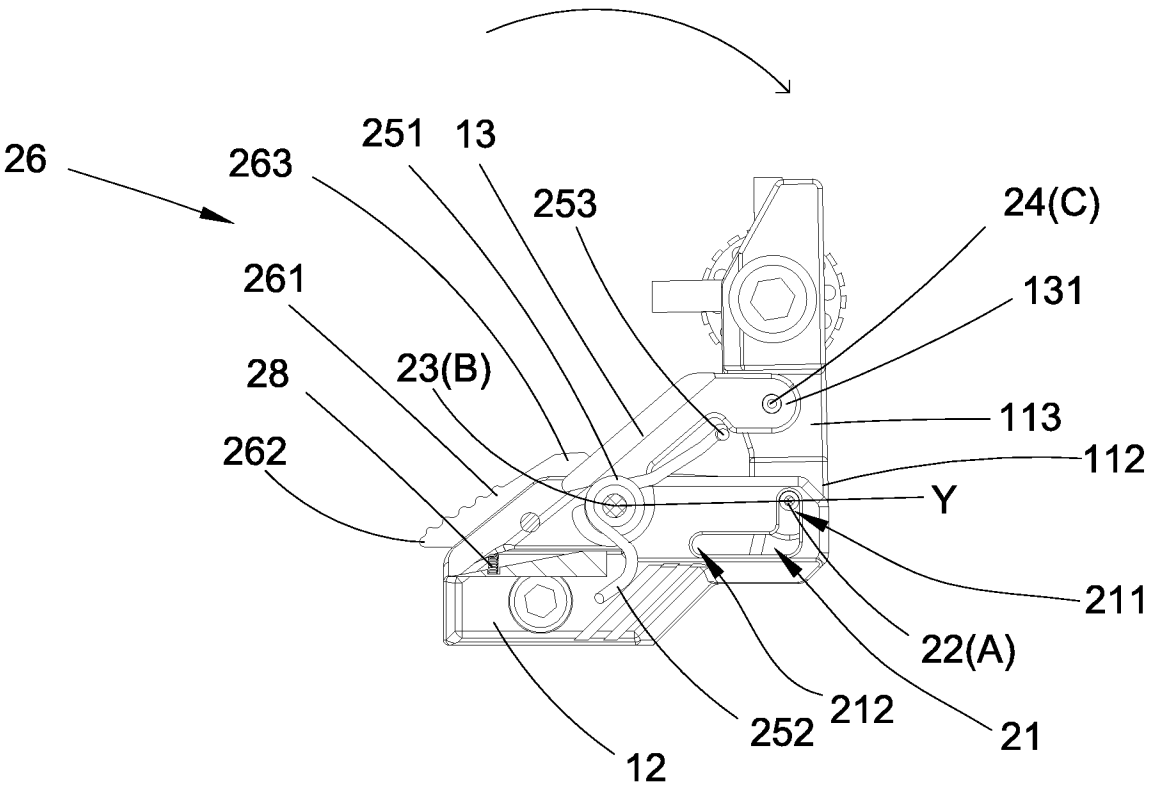
FIG. 4 is a sectional view of a flip up gun sight according to the above mentioned preferred embodiment of the present invention, illustrating the sight housing is in a raised position.
Figure 5:
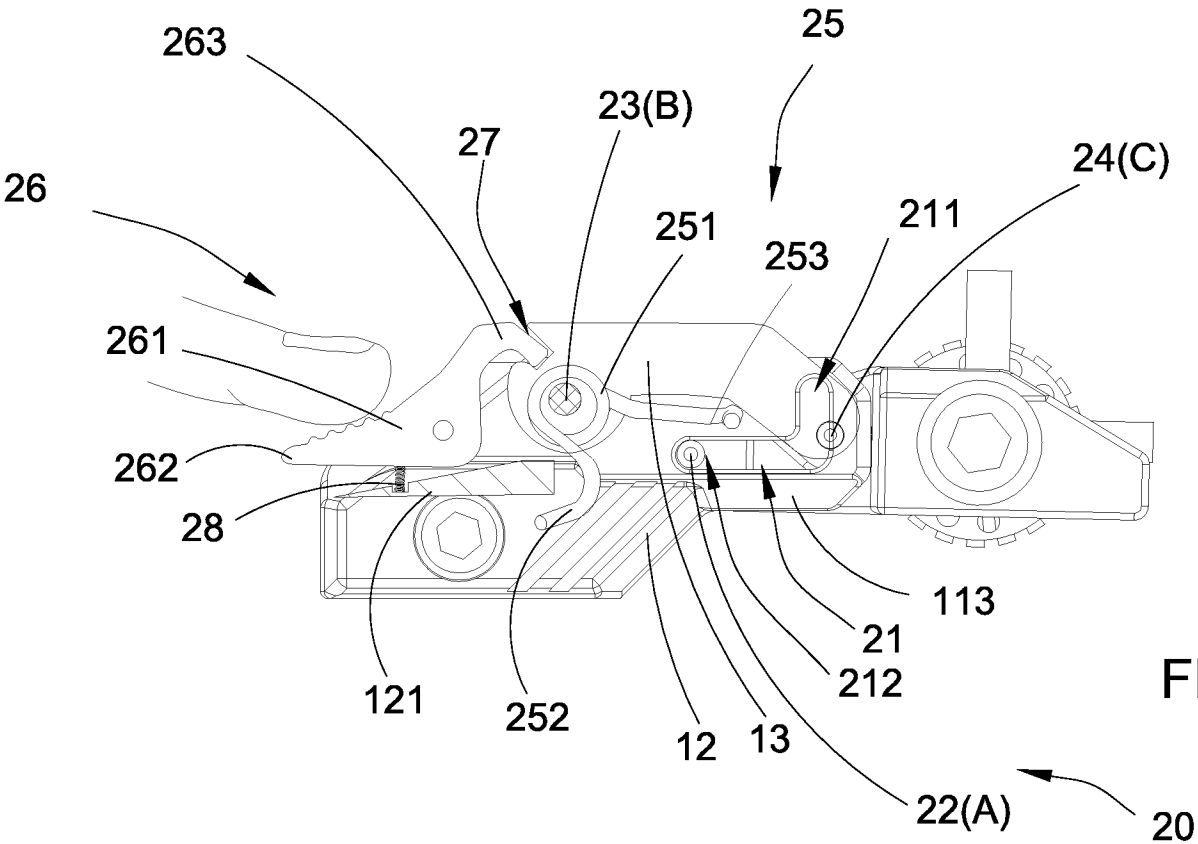
FIG. 5 is a sectional view of a flip up gun sight according to the above mentioned preferred embodiment of the present invention, illustrating the sight housing is in a down position.
Figure 6A:
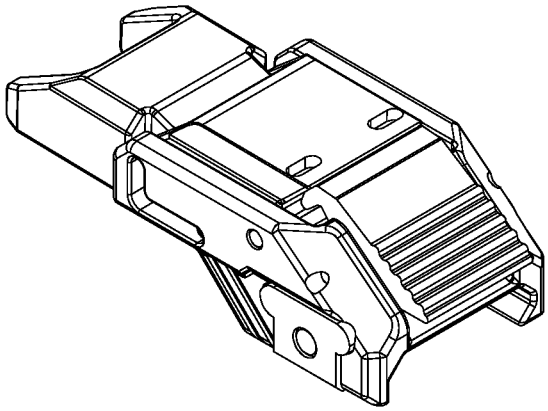
FIGS. 6A to 6J are perspective views and front, rear, top, bottom, and end views of a flip up gun sight according to the above mentioned preferred embodiment of the present invention.
Figure 6B:
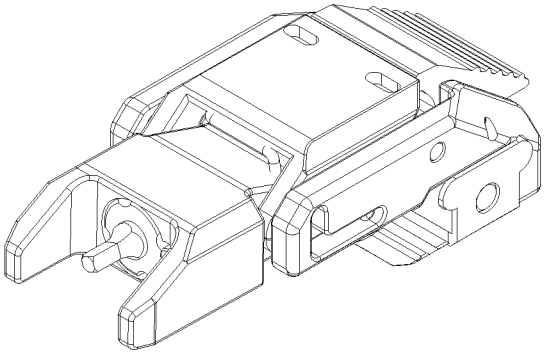
Figure 6C:
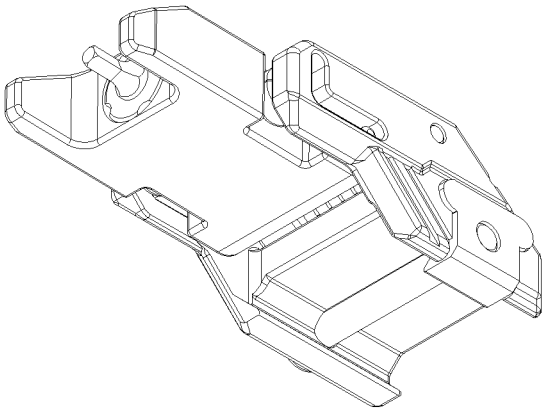
Figure 6D:
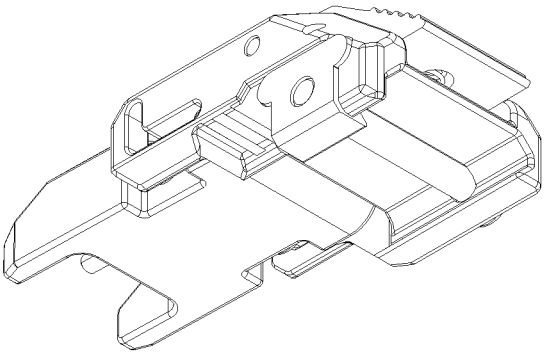
Figure 6E:
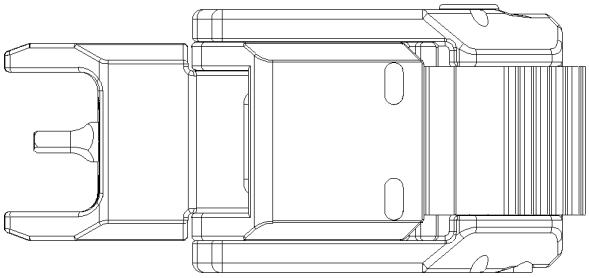
Figure 6F:
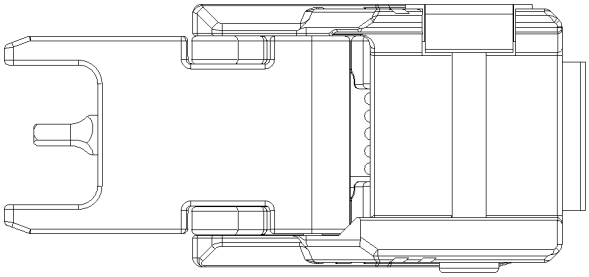
Figure 6G:
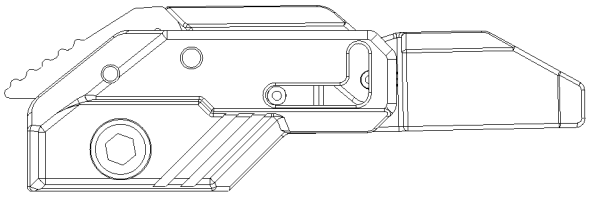
Figure 6H:
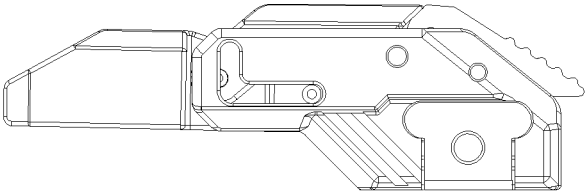
Figure 6I:
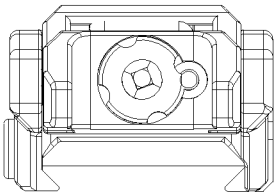
Figure 6J:
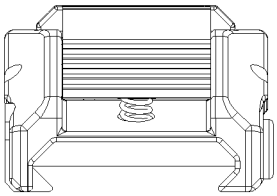

Referring to FIG. 4 and FIG. 5 of the drawings, the supporting member 13 is inclinedly and pivotally connected with the base member 12 and the sight housing 11, wherein, in the raised position, the sight housing 11 is upright, and the supporting member 13 is inclinedly connected with the base member 12 to form a 45 degrees angle. Accordingly to the above mentioned preferred embodiment, the base member 12, the supporting member 13, and the sight housing 11 are pivotally connected with each other through three connection points, and the sight housing 11 and the supporting member 13 are synchronizedly moving with each other through the locking and folding mechanism 20. As shown in FIG. 5, at the down position, the sight housing 11 is pushed downwardly to align with the base member 12, and at the same time, the supporting member 13 is synchronizedly moved downwardly to align with the base member 12 also. In other words, the angle of the inclination of the supporting member 13 is gradually decreased until the supporting member 13 is aligned with the base member 12.

The folding and locking mechanism 20 comprises a pair of curved sliding slots 21 formed on the right tab 122 and the left tab 123 respectively, a first mounting pin 22 passed through the pair of the sliding slots 21 and the pivotal end 112 of the sight housing 11 to connect the sight housing 11 and the base member 12, a second mounting pin 23 passed through the base member 12 and the second supporting end 132 of supporting member 13 to pivotally connect with the base member 12 and the supporting member 13, and a third mounting pin 24 passed through the middle portion 113 of the sight housing 11 and the first supporting end 131 of the supporting member 13 to pivotally connect the supporting member 13 and the sight housing 11. Accordingly, three connection points, a first connection point A, a second connection point B, and a third connection point C, defined at locations of the first, second, and third mounting pins 22, 23, 24 respectively, wherein movements of first and third connection points A, C are synchronizedly generated while only one of the first and third connection points A, C is moved.

It is worth to mention that a shape of each of the pair of the sliding slots 21 on the right and left tabs 122, 123 are identical, and one of sliding slots 21 is aligned with the other of the sliding slots 21. Each of the two sliding slots 21 has a downward curvature matched with a moving path of the sight housing 11, wherein the moving path for the sight housing 11 is matched with the curvatures of the pair of the sliding slots 21. Therefore, when the sight housing 11 is pushed downwardly, the first mounting pin 22 is moving along the curvatures of the sliding slots 21, from each top ends 211 of one of the sliding slots 22 to each of opposite ends 212 of the other of the sliding slots 21, to operate the sight housing 11 from the raised position to the down position.

In the raised position, the first connection point A is located on the top ends 211 of the sliding slots 21 while at the same time the third connection point C is located above the first connection point A. Therefore, the first, second, and third connection points A, B, C are lined to from a triangle, and the first connection point A and the second connection point B are aligned in a same elevation Y, wherein the sight housing 11, the base member 12, and the supporting member 13 are connected with each other to form a triangle. In other words, the sight housing 11 is upwardly arranged and connected with the base member 12, and the supporting member 13 is inclinedly connected with the sight housing 11 and the base member 12.

Accordingly, the second and third mounting pins 23, 24 are two rotational mounting pins. In order to operate the sight housing 11 from the raised position to the down position, the sight housing 11 is pushed downwardly with the rotation of the third mounting pin 24 while at the same time the first mounting pin 22 is slid along the pair of the sliding slots 21 from the top ends 211 to the opposite ends 212 of the two sliding slots 21. Synchronizedly, the supporting member 13 is urged to be received into the housing cavity 125 between the right and left tabs 122, 123 of the base member 12 with the rotation of the second mounting pins 23, wherein the supporting member 13 is pulled to fall down by the sight housing 11 to force the base member 12, the supporting member 13, and the sight housing 11 being folded and overlapped with each other. In other words, the third connection point C is downwardly moved along the moving path of the sight housing 11, and at the same time, the first connection point A is slid downwardly along the curvatures of the sliding slots 21 to reach at a position between the second and the third connection points B, C.

It is worth mentioning that, in the down position, a predetermined proportional of the sight housing 11 is received into the housing cavity 125 between the right and the left tabs 122, 123 as well as receiving underneath the supporting member 13. In other words, since the supporting member 13 and the sight housing 11 are overlapped with each other, a predetermined proportional of the supporting member 13 is also into the housing cavity 125. Therefore, the sight housing 11 and the supporting member 13 can be stored into the housing cavity 125 while the sight housing 11 is in the down position, so as to create a compact configuration of the present invention.

The folding and locking mechanism further comprises a torsion spring 25 which is received around the second mounting pin 23 and passed through with the second supporting end 132 of the supporting member 13 and the base member 12. The torsion spring 25 comprises a spring body 251 surrounded around the second mounting pin 23, a first spring end 252 coupled on the bottom portion 121 of the base member 12, and a second spring end 253 extended along a bottom surface of the supporting member 13 to bias against the sight housing 11. In other words, the second spring end 253 of the torsion spring 25 must be shaped to form a slope which is less than or the same of a slope of the supporting member 13 while the supporting member 13 is in an inclined position. Therefore, the shape of the torsion spring 25 can support the supporting member 13 remaining at the angle of the inclination. It is worth mentioning that the inclination of the supporting member 13 is able to support the sight housing 11 in the raised position, wherein the first and second supporting ends 131, 132 are adapted to connect the sight housing 11 with the base member 12 to affix the sight housing 11 at the raised position.

As shown in FIG. 4, in the raised position, the torsion spring 25 is provided to hold the sight housing 11 in the raised position while torsion spring 25 provides a resistant force to the supporting member 13 to support the supporting member 13 in an inclined position. According to the slope and the location of the torsion spring 25, the resistant force is provided to overcome a gravity force of the supporting member 13, so the supporting member 13 does not discretionarily fall down to overlap on the base member 12. Since the supporting member 13 is remained at the inclined position, the sight housing 11 is naturally affixed at the raised position.

As shown in FIG. 5, in the down position, the sight housing 11 is pushed down by an external force to pull down the supporting member 13, wherein the external force is adapted to overcome the resistant force provided by the torsion spring 25, so as to compress the torsion spring 25. The second mounting pin 23 can be defined as a fulcrum for the supporting member 13, wherein the supporting member 13 is fallen down along a rotation of the second mounting pin 23 towards a direction. Therefore, while the supporting member 13 is forced to fall down, the second spring end 253 of the torsion spring 25 is compressed to fall down, so the external force is required to be larger enough to overcome the resistant force provided by the torsion spring 25. In other words, after the external force is released from the sight housing 11, the torsion spring 25 is expended to generate the resistant force to the supporting member 13 for forcing the supporting member 13 to reinstate in the inclined position along a rotation of the second mounting pin 23 towards an opposite direction. At the same time, the sight housing 11 is synchronizedly forced to operate from the down position to the raised position.

The folding and locking mechanism 20 further comprises a locking member 26 having a middle portion 261 pivotally connected with the base member 12 to lock with the supporting member 13, and a locking groove 27 formed on the second supporting end 132 of the supporting member 13, wherein the locking member 26 is received in the locker cavity 127 of the base member 12. The locking member 26 further comprises a tail portion 262 and a locking hook 263 for selectively locking into the locking groove 27 on supporting member 13, wherein, in the lock position, the locking hook 263 of the locking member 26 is received in the locking groove 27, as shown in FIG. 5, and in the unlock position, the locking hook 263 of the locking member 26 is released from the locking groove 27, as shown in FIG. 4.

Accordingly, the locker member 26 can be adapted to lock the supporting member 13 being overlapped with the sight housing 11. When the supporting member 13 is in the inclined position, the locking groove 27 is received in the housing cavity 127, so the locking hook 263 of the locker member 26 is incapable to engage with the locking groove 263 on the supporting member 12. After the external force is applied on the sight housing 11 to force the sight housing 11 in the down position, the supporting member 13 is overlapped with the sight housing 11, and at the same time, the locking groove 27 is exposed, so the locking hook 263 can be operated to engage with the locking groove 27 for locking the supporting member 13 being overlapped with the sight housing 11. In other words, the sight housing 11 is naturally locked in the down position. In order to operate the sight housing 11 from the down position to the raise position, a free end of the locker member 26 is downwardly pressed to force an opposite end of the locker member 26 being upwardly moved to release from the locking groove 27. In other words, the tail portion 262 of the locking member 26 is pressed to force the locking hook 263 being released from the locking groove 27 on the supporting member 13, and after that, the supporting member 13 reinstates to the inclined position with the sight housing 11 is in the raised position.

The locking and folding mechanism 20 further comprises a spiral spring 28 vertically arranged in a spring hole 1211 formed on the bottom portion 121 of the base member 12 to support the locking hook 263 of the locker member 26 being securely engaged with the locking groove 27 on the supporting member 13. In the unlock position, the spiral spring 28 is compressed by the locking member 26 and the base member 12, and after the locking hook 263 is forced engaged with the locking groove 27 on the supporting member 13, the spiral spring 28 is expended to generate a upward spring force to enhance and secure the engagement therebetween. In order to release the lock position, the tail portion 262 of the locker member 26 is pressed to generate a downward force to overcome the upward spring force provided by the spiral spring 28, and the locking hook 263 of the locking member 26 is naturally released from the locking groove 27 on the supporting member 13.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flip up gun sight, comprising:

a sight housing having a pivotal end;

a base member comprising a left tab and a right tab;

a supporting member having a first supporting end pivotally coupled at said sight housing and a second supporting end pivotally coupled at said base member; and a locking and folding mechanism which comprises a pair of sliding slots formed on said left and right tabs of said base member respectively, and a first mounting pin which is coupled at said pivotal end of said sight housing and is slidably engaged with said sliding slots, wherein said pivotal end of said sight housing is slid along said sliding slots and pivotally moved between said left and right tabs in order to operate between a raised position that said sight housing is moved in an upright manner and a down position that said sight housing is folded on said base member.

2. The flip up gun sight, as recited in claim 1, wherein said sight housing further has a U-shaped alignment end opposite to said pivotal end and a middle portion defined between said U-shaped alignment and said pivotal end, wherein said first supporting end of said supporting member is pivotally coupled at said middle portion of said sight housing.

3. The flip up gun sight, as recited in claim 1, wherein each of said sliding slots has a top end and a down end opposite to said top end, wherein said pivotal end of said sight housing is slid at said top ends of said sliding slots when said sight housing is moved at said raised position while said pivotal end of said sight housing is slid at said down ends of said sliding slots when said sight housing is moved at said down position.

4. The flip up gun sight, as recited in claim 2, wherein each of said sliding slots has a top end and a down end opposite to said top end, wherein said pivotal end of said sight housing is slid at said top ends of said sliding slots when said sight housing is moved at said raised position while said pivotal end of said sight housing is slid at said down ends of said sliding slots when said sight housing is moved at said down position.

5. The gun sight, as recited in claim 3, wherein each of said sliding slots has a curvature between said top and down ends thereof to match with a moving path of sight housing when said sight housing is operated between said raised position and said down position.

6. The gun sight, as recited in claim 4, wherein each of said sliding slots has a curvature between said top and down ends thereof to match with a moving path of sight housing when said sight housing is operated between said raised position and said down position.

7. The gun sight, as recited in claim 1, wherein said base member further has a housing cavity formed between said left and right tabs to receive said sight housing at said down position.

8. The gun sight, as recited in claim 4, wherein said base member further has a housing cavity formed between said left and right tabs to receive said sight housing at said down position.

9. The gun sight, as recited in claim 6, wherein said base member further has a housing cavity formed between said left and right tabs to receive said sight housing at said down position.

10. The gun sight, as recited in claim 1, wherein said supporting member is inclinedly extended between said sight housing and said base member when said base housing is moved at said raised position, and said supporting member is overlapped with said sight housing when said sight housing is moved at said down position.

11. The gun sight, as recited in claim 4, wherein said supporting member is inclinedly extended between said sight housing and said base member when said base housing is moved at said raised position, and said supporting member is overlapped with said sight housing when said sight housing is moved at said down position.

12. The gun sight, as recited in claim 9, wherein said supporting member is inclinedly extended between said sight housing and said base member when said base housing is moved at said raised position, and said supporting member is overlapped with said sight housing when said sight housing is moved at said down position.

13. The gun sight, as recited in claim 1, wherein said locking and folding mechanism further comprises a locking groove form on said supporting member, and a locking member pivotally coupled at said base member to selectively engage with said locking groove so as to lock up said sight housing at said down position.

14. The gun sight, as recited in claim 4, wherein said locking and folding mechanism further comprises a locking groove form on said supporting member, and a locking member pivotally coupled at said base member to selectively engage with said locking groove so as to lock up said sight housing at said down position.

15. The gun sight, as recited in claim 12, wherein said locking and folding mechanism further comprises a locking groove form on said supporting member, and a locking member pivotally coupled at said base member to selectively engage with said locking groove so as to lock up said sight housing at said down position.

16. The gun sight, as recited in claim 13, wherein said locking and folding mechanism further comprises a spiral spring arranged between said locking member and said base member to provide an upward spring force to said locking member for enhancing an engagement between said locking groove and said locking member.

17. The gun sight, as recited in claim 14, wherein said locking and folding mechanism further comprises a spiral spring arranged between said locking member and said base member to provide an upward spring force to said locking member for enhancing an engagement between said locking groove and said locking member.

18. The gun sight, as recited in claim 15, wherein said locking and folding mechanism further comprises a spiral spring arranged between said locking member and said base member to provide an upward spring force to said locking member for enhancing an engagement between said locking groove and said locking member.

19. The gun sight, as recited in claim 1, wherein said second supporting end of said supporting member is pivotally coupled with said base member via a second mounting pin.

20. The gun sight, as recited in claim 18, wherein said second supporting end of said supporting member is pivotally coupled with said base member via a second mounting pin.

21. The gun sight, as recited in claim 19, wherein said folding and locking mechanism further comprises a torsion spring having a first spring end coupled on said base member, a spring body coupled around said second mounting pin, and a second spring end biased against said sight housing, wherein said torsion spring applies a force to push said sight housing at said raised position.

22. The gun sight, as recited in claim 20, wherein said folding and locking mechanism further comprises a torsion spring having a first spring end coupled on said base member, a spring body coupled around said second mounting pin, and a second spring end biased against said sight housing, wherein said torsion spring applies a force to push said sight housing at said raised position.

* * * * *